United States Patent [19]

Crum

[11] 3,936,008

[45] Feb. 3, 1976

[54] REEL STAND TENSION CONTROL SYSTEM

[75] Inventor: James N. Crum, Stonington, Conn.

[73] Assignee: Harris Corporation, Cleveland, Ohio

[22] Filed: July 1, 1974

[21] Appl. No.: 484,997

[52] U.S. Cl. ..... 242/75.44; 242/75.51

[51] Int. Cl.² ..... B65H 23/08; B65H 25/22

[58] Field of Search ..... 242/75.44, 75.43, 75.47, 242/75.51, 189, 190, 75.45, 75.52, 75.53; 318/6, 7

[56] References Cited

UNITED STATES PATENTS

| | | | |
|---|---|---|---|
| 2,965,326 | 12/1960 | Rockstrom | 242/75.43 |
| 3,031,152 | 4/1962 | Cohen et al. | 242/75.51 |
| 3,497,154 | 2/1970 | Lasarev et al. | 242/75.44 |
| 3,564,219 | 2/1971 | Mutziger | 242/75.51 UX |
| 3,718,289 | 2/1973 | Alaimo | 242/75.51 X |
| 3,822,838 | 7/1974 | Butler et al. | 242/75.44 |
| 3,834,648 | 9/1974 | Rose et al. | 242/75.51 X |

*Primary Examiner*—Stanley N. Gilreath
*Assistant Examiner*—John M. Jillions

[57] ABSTRACT

A web tension control system for a reel stand used with a web-fed printing press in which web material is pulled into the press and unwound from a roll on a reel and having a dancer engaging a loop in the web material intermediate the roll and the press. The dancer applies a constant force to the web material at the loop irrespective of the position of the dancer within its range of travel. The reel is equipped with a friction brake whose retarding torque is controlled by a resultant control signal to which several signals contribute. A first signal contributing to the resultant control signal is proportional to the instantaneous radius of the roll of web material and is produced by digitally dividing the press speed by the angular speed of the reel. A second contributing signal is a negative feedback signal that is proportional both to the computed roll radius and to the dancer position. Torque applied by the brake in response to the resultant signal tends to maintain the dancer in a predetermined central position. When the press is coming to a stop a predetermined web tension is achieved by controlling the brake torque in proportion only to the first signal.

15 Claims, 4 Drawing Figures

REEL STAND TENSION CONTROL SYSTEM

BACKGROUND OF THE INVENTION

Paper to be printed by a web-fed printing press is usually supplied in a roll which is mounted on a reel stand at the input end of the press and the paper is unwound continuously from the rollas the press requires it. The web of paper is preferably maintained under a constant predetermined amount of tension between the roll and the printing press, because if the tension is too high the web breaks and if it is too low, the web wanders laterally in the press. The tension in the web must be prevented from exceeding its breaking tension when the press is being stopped also.

A variety of apparatus is used in the prior art to maintain constant tension in the web between the reel stand and the press. For example, the tension is sensed by strain gauges at the bearings of an idler roll over which the web passes to change direction, and the torque of a brake or motor at the reel stand is controlled in accordance with the strain gauge signal.

SUMMARY OF THE INVENTION

The present invention is a web tension control system for a reel stand, for use with a web-fed printing press in which web material is pulled toward the press and unwound from a roll on the reel. A dancer engages the web of material and changes its direction; the dancer applies a transverse force to the web material that is substantially constant irrespective of the transverse position of the dancer within a range of positions. A means for applying mechanical torque, (for example, a pneumatically controlled or electrically controlled friction brake), is coupled to the reel. The torque applied to the reel is controlled in response to a signal that is produced by combining at least two contributing signals. One of the two contributing signals is proportional to the instantaneous radius of the progressively diminishing roll of material; this tends to produce constant tension in the web, and is the principle signal. A second signal that contributes to the resultant control signal is a negative feedback signal, whose magnitude and sign depend at least in part upon the position of the dancer, the second signal being of such sign as to tend to hold the dancer in a predetermined intermediate position in its range. If desired, the second signal may also be proportional to the radius of the material roll. When the press is to be stopped the torque device is switched so as to be responsive to a different signal to prevent breaking of the web.

The signal that is proportional to the radius of the material roll is produced in a specific embodiment of the invention by digital means that computes a ratio of press speed to the angular speed of the material roll. Other aspects and features of the invention are apparent in the specification and figures herein.

DESCRIPTION OF A PREFERRED EMBODIMENT

Figures 1, 2:
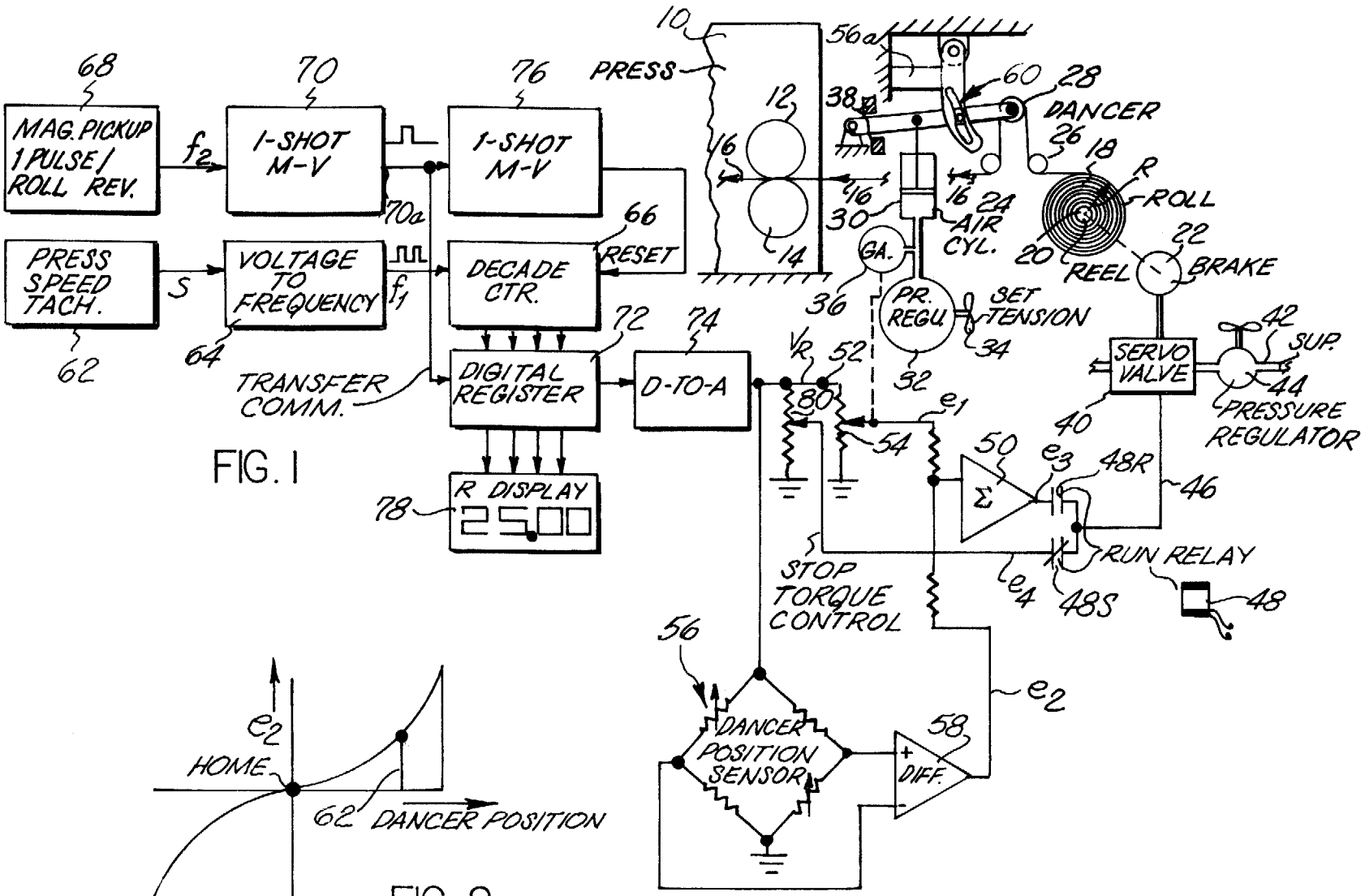
FIG. 1 is a schematic diagram of a printing press, a paper roll, and a tension control system made in accordance with the present invention.
FIG. 2 is a graph of a voltage produced by a transducer as a function of the position of a dancer which is a part of the tension control system of FIG. 1.

In a preferred embodiment of the invention illustrated in FIG. 1 a printing press 10 has rolls 12, 14 forming a nip at the input end of the press which pulls a web of paper 16 or other stock into the press under tension. The paper 16 is unwound from a roll 18 that is mounted on a reel stand (not shown). As the paper is unwound from the roll 18 the radius R of the roll of paper progressively decreases. A friction brake 22 is maintained in dragging engagement with a reel 20 upon which the roll 18 of paper is wrapped.

In order to maintain constant tension in the web between the roll 18 and the press 10 two direction changing idler rollers 24, 26 are provided, with a dancer 28 forming a loop in the web 16 between them. The dancer 28 applies constant force transversely to the web 16 by means of an air cylinder 30, which is under air pressure from a pressure regulator 32. The air pressure is set to suit the web 16 by a knob 34, and a gauge 36 indicates the pneumatic pressure setting, which is maintained constant thereafter by the regulator 32. The force applied by the dancer 28 to the web 16 is therefore maintained at a constant predetermined value irrespective of the position of the dancer, so long as the dancer does not bear upon either of two stops 38 that limit its range of travel. In normal running operation of the press the dancer is prevented from touching the stops 38 by varying the torque of the brake 22, as will be described more fully hereinafter. Because the force applied to the web 16 by the dancer 28 is constant during running, the tension in the web is substantially constant.

The brake 22 is a pneumatically actuated friction brake which is controlled by a pneumatic servo valve 40. Air pressure is supplied to the servo valve 40 from an air line 42 and through a constant pressure regulator 44. The servo valve 40 controls the amount of torque applied to the reel 20 by the brake 22 in accordance with an electrical control signal on a conductor 46, which is connected to the servo valve 40.

The control signal for the servo valve 40 is selected by means of a "run relay" 48 having contacts 48R and 48S. A signal $e_3$ is selected when the press is running routinely, (Run mode), and a signal $e_4$ is selected for use when the press is coming to a stop, (Stop mode). The Run mode of press operation is described first. The contacts 48R are closed and the contacts 48S are open so that the voltage signal $e_3$ determines the amount of torque applied by the brake 22. The signal $e_3$ is produced by adding together two principal input signals $e_1$ and $e_2$ in a summing amplifier 50. Signal $e_1$ is the main signal and $e_2$ is a trimming signal provided by the dancer position, as will be described hereinbelow. The amplifier 50 also has an adjustable bias signal and a gain control which are not shown and which are conventional for summing amplifiers.

The signal $e_1$ contributes (to the resultant control signal $e_3$) a component of signal that is proportional to the radius of the roll 18 and also proportional to the tension to which the web is to be regulated. The signal $e_1$ is a product of a voltage $V_R$ and the position of the armature of a potentiometer 54. The voltage $V_R$, which stands at a terminal 52 to which one end of the potentiometer 54 is connected, is proportional to the radius R of the roll 18, as calculated by a digital electronic system to be described below. The position of the armature of the potentiometer 54 is controlled by the gauge 36 to be proportional to the tension setting of the dancer 28, as established by the setting of the knob 34 of the pressure regulator 32. The component of braking torque which results only from the signal component $e_1$ tends to maintain a constant tension in the web 16, because a web under constant tension applies a pulling torque to the roll 18 which is proportional to the radius R. As the press operates, the radius R of the roll 18 diminishes, and as a result the torque applied to the roll 18 by the web 16, (whose tension is held approximately constant), diminishes progressively. To prevent the peripheral speed of the roll 18 from also diminishing, the torque applied by the brake 22 to the reel 20 is made to diminish progressively, by progressive reduction of the voltage $V_R$ at the terminal 52.

The signal $e_2$ is proportional to a product of the radius signal $V_R$ at the terminal 52 and the degree of imbalance of a strain gauge bridge 56, which senses the position of the dancer. Voltages at the bridge output terminals are connected to subtract, one from the other, in a differential amplifier 58, whose output signal is the signal $e_2$. The differential amplifier 58 has conventional gain and offset controls that are not shown. The signal $e_2$ can be either positive or negative in accordance with the sign of imbalance of the bridge 56. The strain gauge bridge 56 is mounted in a position 56*a* on a member that is actuated by a nonlinear cam 60 in response to the position of the dancer 28. The signal $e_2$ is of the nature of an error signal for the position of the dancer, measured with respect to a predetermined "home" position intermediate the stops 38. As shown in FIG. 2, when the dancer 28 is at the home position the voltage $e_2$ is zero and has a shallow slope, corresponding to low loop gain. At another position 62 of the dancer the voltage $e_2$ is positive and the rate of change of voltage with respect to dancer position is greater, corresponding to greater loop gain. System stability is improved by reducing the system gain when the dancer is at and near its center position. Of course, other devices could be used to sense the dancer position, such as a differential transformer or a potentiometer.

The sign of the voltage $e_2$ is such as to provide a negative feedback component of brake control signal that alters the friction applied by the brake 22 to bring the dancer back to the home position.

In a somewhat oversimplified view of the operation of the system the dancer 28 maintains the web tension constant because the dancer force is held constant irrespective of dancer position; the brake 22 controls the amount of web material between the press 10 and the roll 18 so as to maintain the dancer in a central position away from both of its stops, to enable the dancer to perform its function of maintaining constant web tension.

It is possible to control web tension even with the dancer bottomed against a mechanical stop, by controlling the brake torque, but such a system would not be as precise when the press is in a Run mode. The negative feedback signal produced by the dancer operates on the reel brake to improve the accuracy of the system. Moreover, the dancer has a paper storage capability which, combined with its inertia properties, "filters out" high frequency tension variations produced by the reel which are beyond the response speed capability of the brake torque system alone.

Electronic equipment shown at the left side of FIG. 1 produces the signal $V_R$, which is proportional to the radius R of the roll 18, by measuring and computing a ratio of printing press speed to the angular velocity of the roll 18. The speed of the printing press 10 is detected by a dc tachometer 62 that is coupled to the press. The voltage from the tachometer 62, which is proportional to press speed, is converted by a voltage-to-frequency converter 64 into a continuous train of pulses whose frequency is proportional to the speed of the press. The pulses thus produced are counted in a four digit decade counter 66, which for the moment is assumed to have been reset to 0 when the roll 18 was at a particular angular position, as will be described later. The data contents of the counter 66 progressively increase as the pulses received from the voltage-to-frequency converter 64 are counted.

Once per revolution of the roll 18 a magnetic pickup 68 located near the reel 20 detects the arrival of a protuberance such as a bolt on the reel 20 at a particular angular position, in a conventional manner, to produce a pusle indictating that the reel has arrived at that particular angular position. The trailing edge of the pulse from the pickup 68 triggers a one-shot multivibrator 70, which in response thereto produces a single output pulse of normalized height and duration at a terminal 70*a*.

The leading edge of the pulse at the terminal 70*a* serves as a transfer command to transfer the instantaneous contents of the decade counter 66 into a digital data storage register 72. A digital-to-analog converter 74 of conventional design converts the digital data of the digital register 72 into the analog signal $V_R$ at the terminal 52. The decade counter 66 is then reset by a second one-shot multivibrator 76, which produces a reset pulse for the decade counter 66 upon the trailing edge of the pulse at the terminal 70*a*.

To summarize, the magnetic pickup 68 resets the decade counter 66 once for each revolution of the roll 18 and the decade counter 66 counts the press speed pulses that occur during each revolution of the roll 18. The data in the digital register 72 are updated once per revolution of the roll 18 upon occurence of the transfer command pulse at the terminal 70*a*. The contents of the digital register 72, which represent the most recently measured radius value of the roll 18, are converted to the analog voltage $V_R$ and are also displayed in a digital display device 78 for the convenience of the operator.

The torque required at the brake is $T_R = T_1WR$, where $T_R$ = Run brake torque in inch pounds, $T_1$ = web tension in pounds per inch of web width, W = web width in inches, and R = roll radius in inches. The first component signal $e_1$ is made approximately proportional to the required brake torque.

The following statements show that the signal $V_R$ is proportional to the radius R of the roll 18:

The frequency $f_1$ of pulses from the press voltage-to-frequency converter 64 is proportional to press speed S. $f_1 = k_1S$, where $k_1$ is a constant. The magnetic pickup 68 produces pulses having a frequency $f_2$, which is proportional to the angular velocity A of the roll 18. Thus $f_2 = k_2A$, where $k_2$ is a constant. The period of this second signal is a time $t_2$, which is inversely proportional to the angular velocity A. Hence, $t_2$ $1/k_2A$. The number of pulses N of frequency $f_1$ which occur during a time $t_2$ is $N = f_2.t_2 = k_1 S/k_2A$. The radius R of the paper roll is related to S and A as follows: $R = k_3S/A$, where $k_3$ is a constant. By setting the gains of the apparatus in such a way that $k_3 = k_1/k_2$, N is made equal to R, so that N is a digital measurement of the radius of the roll 18. The voltage $V_R$ at the terminal 52 is proportional to N, and hence is proportional to the roll radius R.

When the Run relay 48 is deenergized to stop the press, the contacts 48R open and the contacts 48S close, connecting the stop torque signal $e_4$ to the conductor 46 to control the servo valve 40 and hence the brake 22. The stop torque signal $e_4$ is obtained from the armature of a stop torque adjustment potentiometer 80, whose overall excitation signal is the voltage $V_R$ at terminal 52, FIG. 1. Thus, for stopping purposes the torque applied by the brake 22 to the reel 20 is proportional by some manually selectable proportionality constant, to the radius R of the roll 18, so that a constant tension is maintained in the web 16 during the stopping time interval. The potentiometer 80 is adjusted to produce a web tension below the value of tension at which the web 16 would break. The position of the dancer 28 during stopping is immaterial, but the dancer 28 would ordinarily be pressed against one of the stops 38 while the press 10 is coming to a stop.

Figure 3:
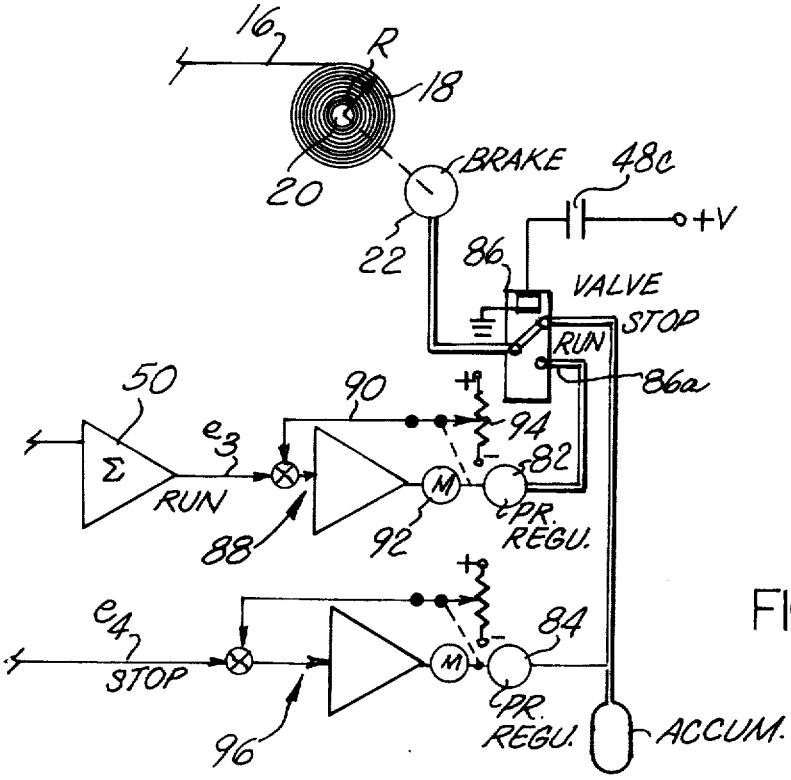
FIG. 3 is a fragmentary schematic diagram of a second embodiment of a brake control portion of the tension control system.

A second embodiment of a portion of the system, that replaces the servo value 40 and the pressure regulator 42, is shown in FIG. 3. FIG. 3 has two motor-adjusted pressure regulators, namely a regulator 82 for use in the Run mode of the press and a regulator 84 for use when the press is stopping. A "three-way" solenoid valve 86 selects either regulator 82 or regulator 84 in response to a voltage V across contacts 48*c* which may form part of the relay 48 of FIG. 1.

The pressure of the pressure regulator 82, FIG. 3, is set by a servo system, which tracks the resultant run control signal $e_3$ of the summing amplifier 50. A second summing amplifier 88 receives the signal $e_3$ and subtracts from it a negative feedback signal (on a conductor 90 from a potentiometer 94), which is proportional to the pressure of the regulator 82 as set by a motor 92.

An identical servo system utilizing an amplifier 96 causes the pressure of the regulator 84 to track the Stop torque signal $e_4$ in the same way. The Stop torque signal $e_4$is obtained from the potentiometer 80, as shown in FIG. 1.

Figure 4:
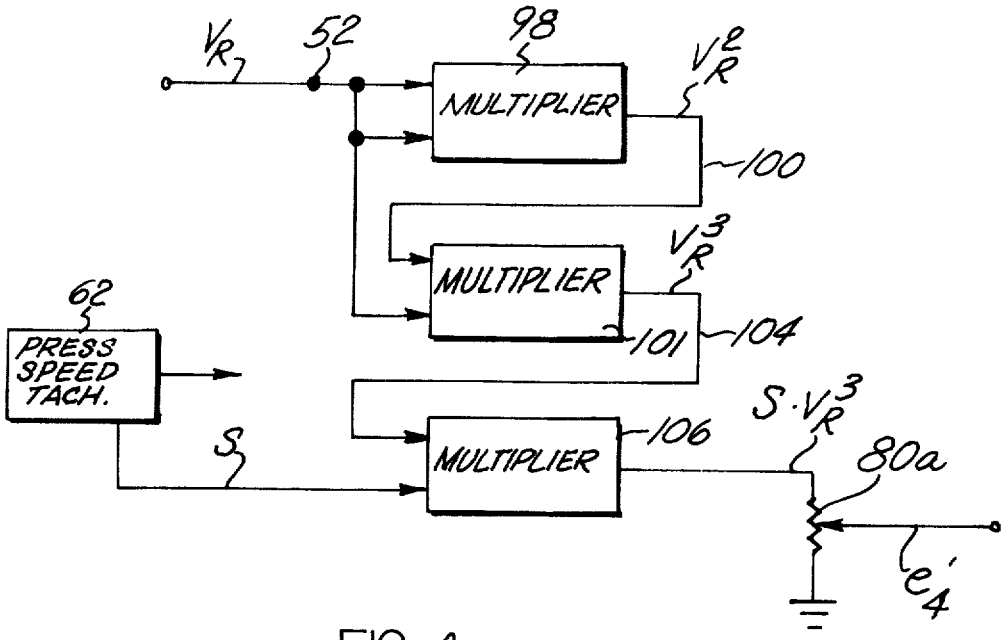
FIG. 4 is a schematic block diagram of a second embodiment of a stopping torque portion of the tension control system of FIG. 1.

If preferred the potentiometer 80 can be replaced by a more complex Stop torque system, shown in FIG. 4, for different performance. It can be shown that the torque $T_S$ required to stop the roll 18 in a time $t$, when a small effect of the steel core of the roll is neglected, is $T_S$ 32 $WSR^3D\pi/(10gt)$, where $T_S$ = Stop brake torque in inch pounds; S = press speed in feet per minute; D = paper density in pounds per cubic inch; $g$ = acceleration of gravity = 386.4 inches/sec$^2$; and $t$ = stopping time in seconds. The circuit of FIG. 4 produces a signal proportional to the variable components of the foregoing expression for $T_S$. The fixed factors of the expression for $T_S$ are taken in account in the gain setting of the system.

In FIG. 4 the signal $V_R$ at the terminal 52 is applied to both of the input terminals of an analog multiplier 98 of conventional design, to produce an output signal at a conductor 100 that is proportional to $V_R^2$. The signal on conductor 100 is connected to one input of a second multiplier 101, whose other input receives the signal $V_R$ from terminal 52, so that the output of the multiplier 101 is a signal on a conductor 104 proportional to $V_R^3$.

The conductor 104 is connected to one input of another multiplier 106 whose second input terminal receives a voltage proportional to press speed from the press tachometer 62 of FIG. 1, so that the output of the multiplier 106 is a voltage proportional to $SV_R^3$. The analog multipliers 98, 101, 106 of FIG. 4 are commercially available from numerous sources, one of which is Burr-Brown Research Corporation of International Airport Industrial Park, Tucson, Arizona. The output voltage from the multiplier 106 is applied overall to the potentiometer 80*a*, whose armature is adjusted for appropriate stopping torque to provide a stopping torque signal $e_4'$, which can be substituted in place of signal $e_4$ of FIG. 1. In this way the stopping torque signal $e_4'$ is made proportional to $Sv_R^3$.

In still another embodiment, an electrically actuated brake is controlled directly by the Run signal $e_3$ and the stop signal $e_4$, without a pneumatic interface. The brake 22 could also be replaced by a motor or an electrical dynamic brake.

A web tension control system for a reel stand in which web material is unwound from a roll on the reel has been described, wherein a dancer applies a constant transverse force to the web of material and the dancer is maintained in an intermediate position by controlling the friction of a reel brake in accordance with a plurality of signals including at least a main signal that is digitally produced to be proportional to roll radius, and a trimming negative feedback signal that depends upon dancer position.

What is claimed is:

1. In a web tension control system for a reel stand used with a web-fed printing press in which web material is pulled toward the press by a pulling means and unwound from a roll on a reel in which a dancer engages the web material between the roll and the pulling means for applying a transverse force to the web material that is substantially constant for all transverse positions within a range of positions and having means to apply torque to the reel in response to a control signal to control the length of said web material between the roll and the pulling means and thereby controlling the dancer's position, radius signal means for producing a radius signal which varies in accordance with the radius of the roll of web material, sensing means for sensing the position of said dancer, first circuit means coupled to said radius signal means and to said sensing means for providing a second signal which is in proportion to said radius signal and which varies in response to deviation of the position of said dancer from a predetermined position, signal combining means for producing said control signal, means coupling a first signal from said radius signal means to said signal combining means, means coupling said second signal to said signal combining means, and means coupling said control signal to control said means to apply torque to maintain said dancer in a predetermined intermediate position in said range to maintain web tension substantially constant.

2. A web tension control system for a reel stand as defined in claim 1 wherein said means coupling said first signal to said signal combining means further comprises means for providing a percentage of said radius signal and setting means for selecting the percentage in correspondence with a selected magnitude of said transverse force applied to said web.

3. A web tension control system for a reel stand as defined in claim 1 and wherein said means for sensing the postion of said dancer comprises strain gauge means responsive to the position of said dancer to produce an electrical position signal.

4. A web tension control system for a reel stand as defined in claim 1 and wherein said means for sensing the position of said dancer comprises nonlinear sensing means producing an output signal that responds relatively insensitively to variations in said dancer position for dancer positions close to said predetermined intermediate position and whose output signal responds relatively more sensitively to variations in dancer position for dancer positions farther from said predetermined intermediate position.

5. A web tension control system for a reel stand as defined in claim 1 wherein said sensing means comprises a dancer position transducer for producing a dancer position signal in response to said position, and means coupling said radius signal means to said position transducer, the output of said position transducer comprising said second signal whereby said means for generating a second signal comprises means for multiplying said radius signal by a value indicative of dancer position.

6. A web tension control system for a reel stand as defined in claim 1 and further comprising means for producing a stopping signal, and means responsive to a stop command signal for transferring control of said torque applying means from said control signal to said stopping signal, said means for producing said stopping signal comprising means connected to receive said radius signal for making said stopping signal proportional to said radius signal and independent of said second signal.

7. A web tension control system for a reel stand as defined in claim 6 and wherein said means for transferring control of said torque applying means comprises electrical switching means for selecting said control signal and said stopping signal.

8. A web tension control system for a reel stand as defined in claim 6 wherein said means applying torque to the reel in response to said control signal comprises a first controllable pressure regulator means for producing a fluid pressure signal responsive to said control signal, and second controllable pressure regulator means for producing a fluid pressure signal responsive to said stopping signal and wherein said means for transferring control of said torque applying means comprises fluid selector valve means connected for normally supplying said fluid pressure signal responsive to said control signal, said fluid selector valve being switchable in response to occurrence of a stop command signal to provide said fluid pressure signal responsive to said stopping signal.

9. A web tension control system for a reel stand as defined in claim 1 and further comprising means for producing a stopping signal, and means responsive to a stop command signal for transferring control of said torque applying signal from said control signal to said stopping signal, said means for producing a stopping signal comprising means connected with said radius signal for computing a signal which is the cube of said radius signal, means connected with the press for producing a press signal responsive to press speed, and means for multiplying said cube signal and said press signal to produce said stopping signal.

10. In a method of controlling web tension between a reel stand and web-fed printing press in which web material is pulled into the press and unwound from a roll on the reel comprising the steps of applying a transverse force from a dancer to the web material between the roll and the press, said transverse force being substantially constant for all transverse positions of said dancer within a range of positions, producing a radius signal indicative of the radius of the roll and, sensing the position of the dancer with respect to a predetermined position, the improvement comprising:

producing a negative feedback signal in proportion to a said radius signal and varying said negative feedback signal in accordance with deviation of the dancer from said predetermined position, combining a plurality of signals including at least said negative feedback signal and said radius signal to produce a control signal, and utilizing said control signal to control a torque applied to the reel to maintain the dancer in an intermediate transverse position.

11. A method of controlling web tension between a reel stand and a web-fed printing press in which web material is pulled into the press and unwound from a roll on the reel comprising the steps of applying a transverse force from a dancer to the web material between the roll and the press, said transverse force being substantially constant for all transverse positions of said dancer within a range of positions, producing a radius signal indicative of the radius of the roll and, sensing the position of the dancer with respect to a predetermined position, the improvement comprising:

producing a first signal which is a percentage of said radius signal, producing a negative feedback second signal in proportion to said radius signal and varying said negative feedback signal in accordance with the deviation of said dancer from said predetermined position, combining a plurality of signls including at least said first and second signals to produce a control signal, and utilizing said control signal to control a torque applied to the reel to maintain the dancer in a predetermined intermediate transverse position.

12. A method according to claim 1 wherein the step of producing said first signal further comprises setting said percentage in correspondence with the magnitude of said transverse force.

13. A method according to claim 11 further comprising the steps of producing a stopping signal in proportion to said radius signal and transferring control of said torque applying means from said control signal to said stopping signal.

14. In a web tension system wherein a mechanism operates to feed web material from a roll on a reel located at a location spaced from said mechanism and a dancer engaging said web material between said reel and said mechanism, said dancer varying in position in accordance with the length of material between said reel and said mechanism and maintaining substantially constant tension in said web material, means for providing a first signal which varies in accordance with radius of the roll, means for producing a second signal which varies as the product of the deviation of the dancer from a predetermined position and the radius of the roll, and means for combining said first and second signals to provide a control signal, a torque device for controlling the angular rotation of the reel to control the length of the web material between said reel and mechanism, and means for applying said control signal to said torque device to maintain the dancer roll in a substantially predetermined position.

15. A web tension system according to claim 14 further comprising circuit means for producing a stopping signal in proportion to the radius of the roll and means responsive to a stop command signal for applying said stopping signal to said torque device and disconnecting said control signal from said torque device.

* * * * *

UNITED STATES PATENT OFFICE

CERTIFICATE OF CORRECTION

Patent No. 3,936,008 Dated February 3, 1976

Inventor(s) James N. Crum

It is certified that error appears in the above-identified patent and that said Letters Patent are hereby corrected as shown below:

In claim 12, line 1, after claim, delete "1" and add --11--.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*